United States Patent [19]

Whited

[11] 3,936,176

[45] Feb. 3, 1976

[54] DEVICE FOR MAINTAINING A DEVELOPABILITY REGULATING APPARATUS CONTAMINANT FREE

[75] Inventor: Charles A. Whited, Rochester, N.Y.

[73] Assignee: Xerox Corporation, Stamford, Conn.

[22] Filed: July 19, 1973

[21] Appl. No.: 380,927

[52] U.S. Cl. ..... 355/4; 34/107; 240/47; 250/239; 350/63; 355/30

[51] Int. Cl.[2] ..... G03G 15/01; F21V 29/00

[58] Field of Search ..... 355/3 R, 3 DD, 4, 13, 15, 355/17, 68, 30; 250/237, 238, 239, 573, 576; 350/63; 15/406; 240/2 V, 47; 73/147; 134/37; 239/288, 288.3, 288.5; 34/12, 60, 61, 85, 107, 128, 202, 243 R; 118/64; 356/201, 207, 208, 209, 210; 353/61

[56] References Cited

UNITED STATES PATENTS

| | | | |
|---|---|---|---|
| 1,528,917 | 3/1925 | Fales | 73/147 |
| 1,978,589 | 10/1934 | McFarlane | 250/238 X |
| 3,181,415 | 5/1965 | Laing | 240/47 X |
| 3,310,356 | 3/1967 | Borberg | 350/63 |
| 3,324,291 | 6/1967 | Hudson | 355/15 X |
| 3,427,658 | 2/1969 | Roberts | 355/13 X |
| 3,485,622 | 12/1969 | Sewell | 95/1.1 |
| 3,496,558 | 2/1970 | Willson et al. | 356/207 |
| 3,648,587 | 3/1972 | Stevens | 95/44 R |
| 3,744,873 | 7/1973 | Jamison | 250/239 X |
| 3,754,821 | 8/1973 | Whited | 355/17 X |
| 3,778,146 | 12/1973 | Knapp | 355/3 DD |
| 3,792,230 | 2/1974 | Ray | 219/343 |
| 3,801,196 | 4/1974 | Knapp et al. | 118/637 X |

OTHER PUBLICATIONS

Reba, Imants, "Applications of the Coanda Effect"; Scientific American, June, 1966, pp. 84–92.

*Primary Examiner*—Joseph F. Peters, Jr.
*Assistant Examiner*—Kenneth C. Hutchison
*Attorney, Agent, or Firm*—H. Fleischer; J. J. Ralabate; C. A. Green

[57] ABSTRACT

A device in which a developability regulating apparatus employed in a multi-color electrophotographic printing machine is maintained substantially free from contaminating particles. This is achieved in the present invention by directing a substantially laminar fluid flow over the light source and photosensor used in the developability apparatus.

2 Claims, 3 Drawing Figures

DEVICE FOR MAINTAINING A DEVELOPABILITY REGULATING APPARATUS CONTAMINANT FREE

BACKGROUND OF THE INVENTION

This invention relates generally to a multicolor electrophotographic printing machine, and more particularly concerns a device utilized in a developability regulating apparatus used in the printing machine for maintaining a light source and photosensor employed therein substantially free of contaminating deposits.

Toner particle concentration in the developer mix directly effects the developability of the multi-color electrophotographic printing machine. The concentration of toner particles within the developer mix, i.e., the percentage of toner particles relative to carrier granules relates directly to the characteristics of the developed image. For example, the density and contract of the image will be effected by the toner particle concentration.

Numerous systems have been developed which add toner particles to the developer mix. However, most of these systems operate in an open loop fashion, i.e., there is no feedback between the concentration in the mix and the amount of toner particles to be added thereto. Other systems which operate in a closed loop manner are directed primarily to black and white printing machines rather than multi-color printing machines. A typical system used in a black and white printing machine is disclosed in U.S. Pat. No. 3,399,652 issued to Gawron in 1968. This patent discloses a rotating disc disposed in the developer mix. The disc is electrically biased to attract toner particles from the mix. A light beam is reflected from the surface of the disc onto a photoelectric unit. The intensity of the light rays stricking the photoelectric unit is an indication of the toner particle concentration within the developer mix. However, the foregoing system does not have the disc mounted on the photoconductive member, nor is any apparatus associated therewith for maintaining the light source and photoelectric sensor substantially free of toner particle contamination. Hence, it does not undergo the normal processing steps of the photoconductive member and is subjected to toner particle contamination which may introduce erroneous signals.

One system adapted for use in a multi-color electrophotographic printing machine is described in U.S. Pat. No. 3,754,821 issued to Whited in 1973. As disclosed therein, the developability regulating apparatus includes a transparent electrode mounted on the photoconductive member and adapted to attract electrostatically toner particles thereto. A light source develops a beam of light rays which are transmitted from the interior of the photoconductive drum through the transparent electrode onto the photosensor. The photosensor develops an electrical signal indicative of the density of toner particles adhering to the transparent electrode. In the foregoing system, light rays pass through the transparent electrode rather than being reflected therefrom.

In all of the foregoing systems particle contamination introduces added problems thereto. Frequently, particle contamination will produce erroneous signals in the system. For example, when particles are accumulated on the light source, the intensity of the light rays therefrom is diminished and the photosensor will react substantially in the same manner as though toner particles have been deposited on the electrode, i.e., the intensity of the electrical signal will decrease in accordance with the amount of toner particles deposited on the light source. Similarly, if contaminating particles are deposited on the photosensor, the intensity of the signal therefrom will be reduced in proportion to the amount of toner particles deposited thereon. It is, therefore, evident that the accumulation of contaminating particles on both the light source and photosensor of a developability regulating apparatus utilized in an electrophotographic printing machine must be controlled.

Accumulation of particles in a multi-color electrophotographic printing machine is more significant than in a conventional black and white printing machine. A multi-color electrophotographic printing machine utilizes a plurality of toner particles to be capable of reproducing all of the various colors in an original document. This may produce significantly more particle contamination in the printing machine. Thus, the potentiality for contaminating the various components of the developability regulating apparatus is substantially increased.

Accordingly, it is a primary object of the present invention to improve the developability regulating apparatus utilized in a multi-color electrophotographic printing machine by preventing the accumulation of particle contamination thereon.

SUMMARY OF THE INVENTION

Briefly stated, and in accordance with the present invention, there is provided a device for maintaining an article substantially free from deposits of contaminating particles.

In the particular device illustrated, a closure member is arranged to support the article therein. The closure member has inlet and outlet apertures therein with the article positioned in the region of the inlet aperture thereof. Pursuant to the present invention, means are provided for creating a fluid flow in the closure member. The fluid flow is directed from the inlet aperture to the outlet aperture of the closure member. Further in accordance with the present invention, means are provided for maintaining a substantially laminar fluid flow in the closure member. Thus, in the present invention the laminar fluid flow prevents the accumulation of contaminating particles on the article.

BRIEF DESCRIPTIONS OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
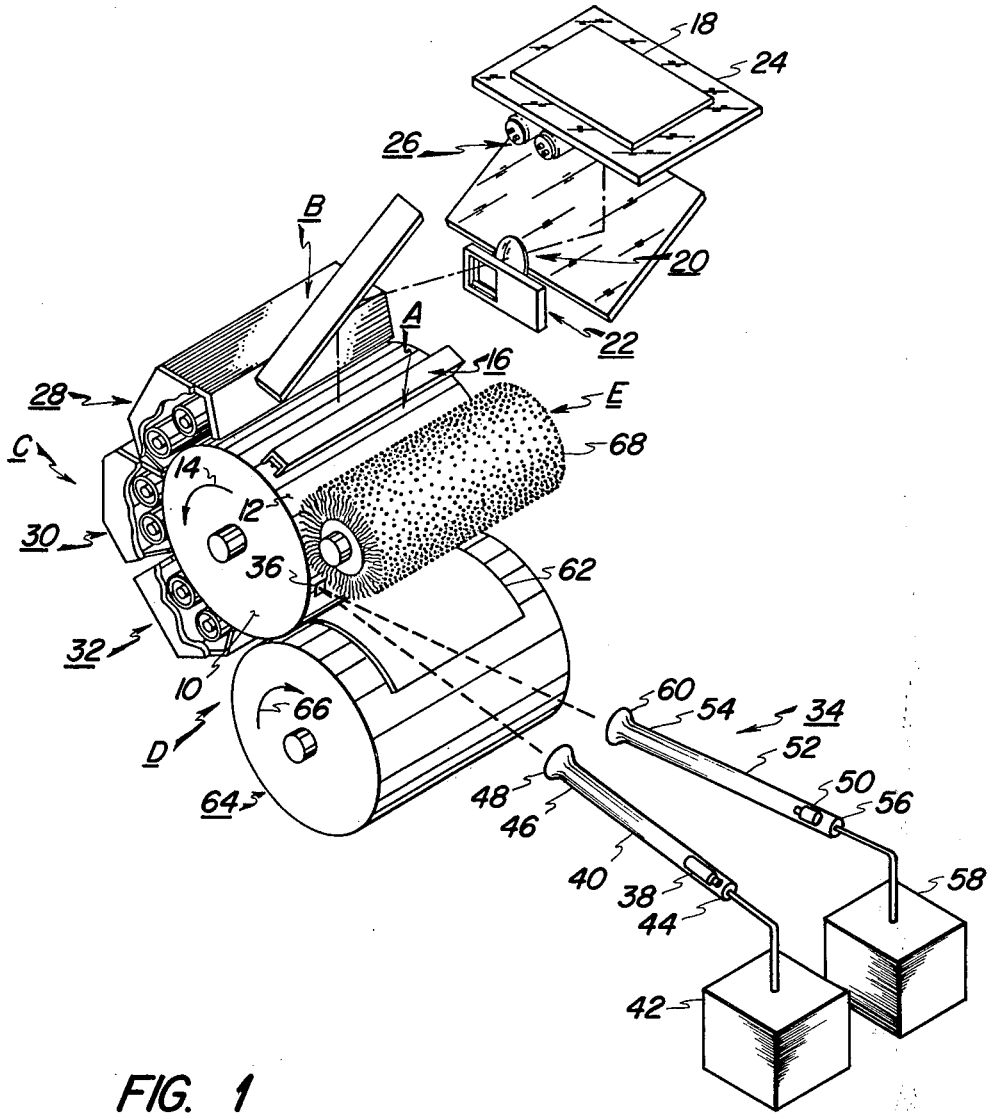
FIG. 1 is a schematic perspective view depicting a multi-color electrophotographic printing machine employing the present invention therein.

For a general understanding of the disclosed multi-color electrophotographic printing machine in which the present invention may be employed, continued reference is had to the drawings. In the drawings, like reference numerals have been used throughout to designate like elements. FIG. 1 schematically illustrates the various components of the multi-color printing machine. Although the apparatus of the present invention is particularly well adapted for use in a multi-color electrophotographic printing machine, it should become evident from the following description that it is equally well suited for use in a wide variety of machines and is not necessarily limited in its use to the particular embodiment shown herein.

As shown in FIG. 1, the multi-color electrophotographic printing machine utilizes an image bearing member having a drum 10 mounted rotatably within the printing machine frame (not shown) and a photoconductive surface 12 secured to the exterior circumferential surface of drum 10 and entrained thereabout. Drum 10 is driven rotatably by a drive motor (not shown), in the direction of arrow 14, at a substantially constant angular velocity. As drum 10 rotates, photoconductive surface 12 passes sequentially through a series of processing stations. The drive motor rotates drum 10 at a pre-determined speed relative to the other operating mechanisms of the printing machine. A timing disc mounted in the region of one end of the shaft of drum 10 cooperates with the machine logic to synchronize the various operations with the rotation of drum 10. In this way, the proper sequence of events is produced at the respective processing stations. One type of suitable photoconductive material is disclosed in U.S. Pat. No. 3,655,377 issued to Sechak in 1972.

Drum 10 initially rotates photoconductive surface 12 through charging station A. A corona generating device, indicated generally at 16, is disposed at charging station A. Preferably, corona generating device 16 extends longitudinally in a transverse direction across photoconductive surface 12. This readily enables corona generating device 16 to generate a spray of ions for charging photoconductive surface 12 to a substantially uniform potential. U.S. Pat. No. 2,778,946 issued to Mayo in 1957 discloses a suitable corona generating device of the type described heretofore.

Thereafter, drum 10 rotates charged photoconductive surface 12 to exposure station B. At exposure station B, a color filtered light image of original document 18 is projected onto charged photoconductive surface 12. Exposure station B includes thereat a moving lens system, generally designated by the reference numeral 20, and a color filter mechanism shown generally at 22. As shown in FIG. 1, an original document 18, such as a sheet of paper, book or the like, is disposed face down on transparent viewing platen 24. A light source, indicated generally by the reference numeral 26, is moved in conjunction with lens system 20 and filter mechanism 22 in a timed relationship with drum 10 to scan successive longitudinally extending incremental areas of original document 18 disposed upon platen 24. In this manner, a flowing light image of original document 18 is projected onto photoconductive surface 12. During exposure, filter mechanism 22 interposes selected color filters into the optical light path of lens 20. Filter 22 operates on the light rays passing through lens 20 to record an electrostatic latent image on photoconductive surface 12 corresponding to a pre-selected spectral region of the electromagnetic wave spectrum, hereinafter referred to as a single color electrostatic latent image. A suitable moving lens system is disclosed in U.S. Pat. No. 3,062,108 issued to May in 1962.

Drum 10 next rotates the single color electrostatic latent image recorded on photoconductive surface 12 to development station C. Development station C includes three individual developer units, indicated generally by the reference numerals 28, 30, and 32, respectively. The developer units are all of the type generally referred to in the art as "magnetic brush developer units". Generally, a magnetic brush developer unit includes a magnetizable developer mix having carrier granules and toner particles therein. The toner particles are usually heat settable. The developer mix is continually brought through a directional flux field to form a brush thereof. The developer mix is continually moving to provide the brush with consistently fresh material. Development is achieved by bringing the brush and developer mix into contact with the electrostatic latent image recorded on photoconductive surface 12. Each of the developer units 28, 30, and 32, respectively, include toner particles corresponding to the complement of the specific color separated electrostatic latent image recorded on photoconductive surface 12. The respective toner particles are selected to absorb light within a pre-selected spectral region of the electromagnetic wave spectrum corresponding to the complement of the wave length of light transmitted through filter 20. For example, a green filtered latent image is rendered visible by depositing green absorbing magenta toner particles thereon. Blue and red filtered latent images are developed with yellow and cyan toner particles, respectively.

A developability regulating apparatus, indicated generally at 34, functions to supply additional toner particles to the system. Regulating apparatus 34 includes electrode means 36 mounted on photoconductive surface 12 of drum 10. A light source 38 is mounted in closure member 40 which has inlet and outlet apertures therein to permit fluid flow to pass therethrough. Fluid flow creating means, or blower 42, is in operative communication with inlet aperture 44 of closure member 40. In this manner, blower 42 produces a fluid flow passing over light source 38 and out through outlet aperture 46 of closure member 40. Preferably, the fluid passing over light source 38 is air. However, it may be any other similar type of fluid or gaseous medium. Laminar flow maintaining means 48 is operatively associated with closure member 40 to maintain the fluid flow in a laminar condition. This insures that excessive back pressure will not develop due to turbulence in the fluid flow which will eventually suck toner particles into closure member 40 and into light source 38. The flow of fluid or air over light source 38 prevents the accumulation of contaminants thereon to maintain the intensity of the illumination therefrom substantially constant. During development, toner particles are deposited on electrode 36 and the intensity of the light rays reflected therefrom is indicative of the density thereof. Photosensor 50 is adapted to receive the light rays reflected from elecrode 36. In response to the light rays received thereon, photosensor 50 produces an electrical output signal corresponding to the density of toner particles adhering to electrode 36. Suitable logic circuitry compares the electrical output signal from photosensor 50 with a pre-determined reference signal.

A logic control signal corresponding to the deviation therebetween is generated for actuating the appropriate toner particle storage container to dispense toner particles into the corresponding developer unit. Photosensor 50 is mounted in closure member 52. Closure member 52 includes outlet and inlet apertures 54 and 56, respectively. Inlet aperture 56 is connected to a suitable blower 58 adapted to produce fluid flow over photosensor 50. Laminar flow maintaining means 60 is connected to closure member 52 in the region of output aperture 54 thereof. In this manner, a laminar flow of fluid passes over photosensor 50 preventing the deposition of contaminating particles thereon. The fluid flow is maintained laminar and turbulence is minimized so that the back pressure will not suck toner particles into closure member 52 and into photosensor 50. The detailed structural configuration of regulating apparatus 34 will be described hereinafter in greater detail with reference to FIGS. 2 and 3.

Continuing now with the description of the electrophotographic printing machine processes, after development, drum 10 rotates to transfer station D. At transfer station D, the toner powder image adhering electrostatically to photoconductive surface 12 is transferred to a sheet of support material 62. Support material 62 may be, amongst others, plain paper or a sheet of thermoplastic material. A transfer roll, shown generally at 64, recirculates support material 62 in the direction of arrow 66. Transfer roll 64 is biased electrically to a potential of sufficient magnitude and polarity to attract electrostatically toner particles from the latent image recorded on photoconductive surface 12 to support material 62. A suitable electrically biased transfer roll is described in U.S. Pat. No. 3,612,677 issued to Langdon et al. in 1971. Transfer roll 64 rotates in the direction of arrow 66 in synchronism with drum 10 (in this case at the same angular velocity therewith). Inasmuch as support material 62 is secured releasable thereon for movement in a recirculating path therewith, successive toner powder images may be transferred thereto in superimposed registration with one another. Preferably, transfer roll 64 includes a suitable recess therein for preventing electrode 36 from engaging transfer roll 64. Thus, toner particles deposited on electrode 36 remain undisturbed by the transfer process and represent an indication of the toner particle concentration within the developer mix.

After the toner powder images have been transferred to support material 62, support material 62 is separated from the surface of transfer roll 64 and advanced to a fusing station (not shown). At the fusing station, the toner powder image is permanently affixed to support material 62. One type of suitable fuser is described in U.S. Pat. No. 3,498,592 issued to Moser at al. in 1970. Support material 62, with the toner powder image affixed thereto, is, thereupon, advanced by conveyors (not shown) to a catch tray (not shown). The catch tray is arranged to permit the machine operator to remove the completed copy from the printing machine.

The last processing station in the direction of rotation of drum 10, as indicated by arrow 14, is cleaning station E. As heretofore indicated, a preponderance of the toner particles are transferred to support material 62, however, some residual toner particles remain on photoconductive surface 12. Cleaning station E removes these residual toner particles from photoconductive surface 12. The residual toner particles are initially brought under the influence of a cleaning corona generating device (not shown) adapted to neutralize the remaining electrostatic charge on the residual toner particles and photoconductive surface 12. Thereafter, the neutralized toner particles are cleaned from photoconductive surface 12 by a rotating fibrous brush 68. Brush 68 is positioned in contact with photoconductive surface 12. One type of suitable brush cleaning device is described in U.S. Pat. No. 3,590,412 issued to Gerbasi in 1971.

Figure 2:
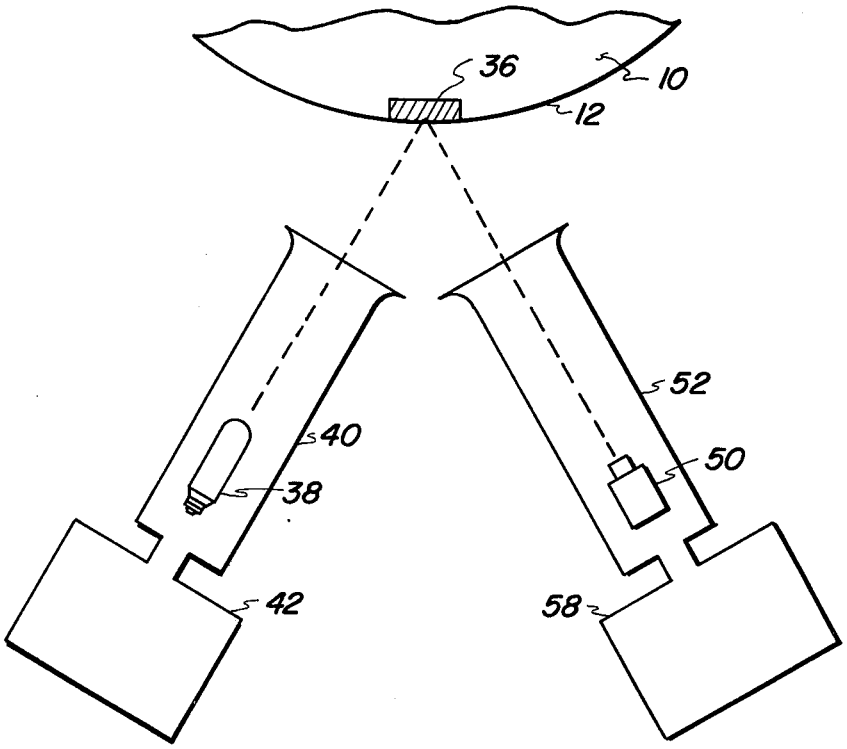
FIG. 2 is a plan view illustrating the developability regulating apparatus utilized in the FIG. 1 printing machine.

It is believed that the foregoing description is sufficient to illustrate the general operation of the present invention in a multi-color electrophotographic printing machine. Referring now to the specific subject matter of the present invention, FIG. 2 illustrates the detailed structural configuration of developability regulating apparatus 34. Regulating apparatus 34 includes electrode 36, light source 38, photosensor 50, closure members 40 and 52, and blowers 42 and 58. In addition, suitable logic circuitry is associated thereith for processing the electrical output signals from photosensor 50. Each of the developer units 28, 30 and 32, respectively, have corresponding toner particle storage containers (not shown) associated therewith. Each of the toner particle storage containers house a supply of selected toner particles having discrete colors to form a reservoir thereof for the appropriate developer unit. By way of example, the toner particle storage container for developer unit 28 contains cyan toner particles, that of developer unit 30 magenta toner particles, and that of developer unit 32 yellow toner particles. Each of the toner particle storage containers include perforations therein adapted to meter therefrom a specified quantity of the selected toner particles to the corresponding developer unit. A suitable oscillator motor vibrates the appropriate toner particle storage container to dispense toner particles therefrom. The toner particles pass through the perforations in the container to the appropriate developer unit. Regulating apparatus 34 actuates the oscillator motor to control the dispensing of toner particles from each of the toner particle storage containers to the respective developer unit.

As shown in FIG. 2, light source 38 produces a beam of light rays which are reflected from electrode 36 to photosensor 42. Electrode 36 is located in a non-image region of photoconductive surface 12. As electrode 36 passes through the development zone, it is electrically biased to an electrical potential simulating the electrostatic latent image recorded on photoconductive surface 12. Preferably, electrode 36 is biased to about 200 volts above the developer bias, the normal developer bias being about 500 volts. However, electrode 36 may be biased from about 100 volts to about 600 volts above the developer bias. The density of the image developed on electrode 36 is sensed by photosensor 42. The output signal from photosensor 50 is processed by suitable logic elements. Thereupon, depending upon the density of toner particles deposited on electrode 36, additional toner particles may or may not be supplied to the respective developer unit. Photosensor 50 is mounted in closure member 52 which is spaced from photoconductive surface 12 of drum 10. Closure member 52 is positioned such that the light rays reflected from elecrode 36 are detected by photosensor 50.

In order to apply the appropriate voltage corresponding to the electrostatic latent image recorded on photoconductive surface 12, electrode 36 is biased to a suitable voltage level. This is achieved, preferably, by mounting a suitable commutator assembly (not shown)

in a region of the end bell of drum 10. A suitable slip ring assembly may be used in lieu of the commutator assembly. Timing for the application of the bias voltage to electrode 36 may be controlled by electronic switching or by the use of a split commutator ring i.e., electrode 36 being biased over one portion of the commutator and not over the remaining portion thereof. The bias voltage is removed from electrode 36 during the cleaning process. It will be readily apparent to one skilled in the art that instead of applying a bias voltage to electrode 36, a suitable bias may be applied thereto by electrical charging.

By way of example, light source 38 is, preferably, a derated tungsten lamp with a regulated voltage, e.g., a 7 volt tungsten filament lamp operating from a 5 volt source. Photosensor 50 is a commercially available silicone phototransistor such as is produced by the General Electric Co., Model No. L14B. Photosensor 50 is maintained in the region of the inlet portion of closure member 50 so that the fluid flow thereover, which is laminar, prevents the accumulation of dirt particles thereon. Blowers 42 and 58 are substantially identical and create a flow of air over light source 38 and photosensor 50, respectively. Blowers 42 and 58 are centrifugal blowers having a 2-pole permanent magnet split capacitor motor, and operate at about 117 volts, 60 hertz with about a 53 CFM capacity at a sea level static pressure of about 0 inches of water. Preferably, the blowers operate at about 10 CFM and maintain the system substantially free of particle contamination.

Electrode 36 may include a glass plug having one surface thereof coated with a silvered coating adapted to reflect the light rays impacting thereon therefrom. A transparent electrically conductive surface is suitably secured to the other surface of the glass plug. The reflective surface thereof is arranged to reflect the light rays transmitted thereto through the transparent electrically conductive surface so that the light rays impinge on photosensor 50. Preferably, the electrically conductive surface is made from a transparent tin oxide coating. A transparent electrically conductive surface of this type is made by Pittsburgh Plate Glass under the trademark NESA, or is made by Corning Glass Company under the trademark Electro Conductive. As hereinbefore indicated, electrode 36 is suitable mounted on drum 10 and is adapted to be electrically biased to the appropriate voltage level to attract toner particles thereto.

While the present invention has been described in connection with electrode 36 being a glass plug with one surface coated with a reflective material and the other surface coated with a tin oxide layer, one skilled in the art will appreciate that the invention is not necessarily so limited. For example, electrode 36 may be a polished stainless steel disc. Preferably, the reflective disc is 09–1401 stainless steel having the reflective surface polished to substantially about five rings flatness.

Figure 3:
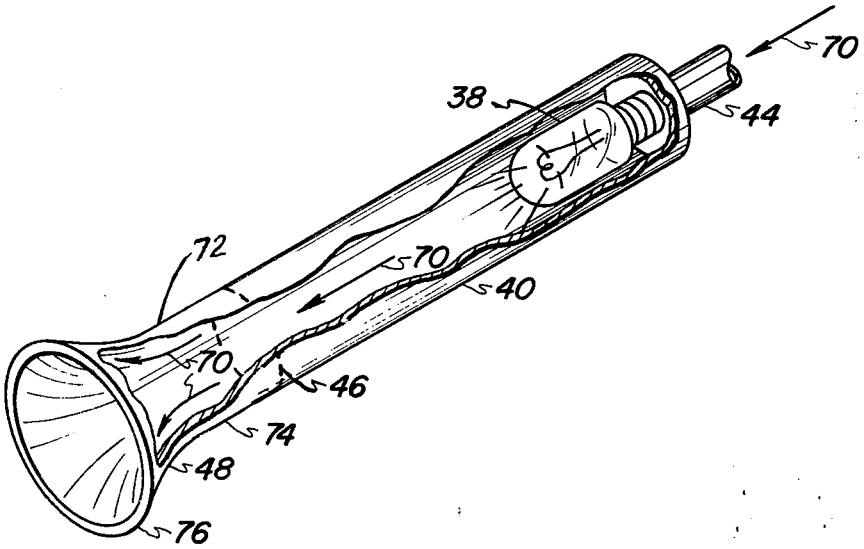
FIG. 3 is a perspective view depicting the features of the present invention therein.

Turning now to FIG. 3, there is shown the detailed structural configuration for maintaining the air flow passing over light source or lamp 38 substantially laminar. While FIG. 3 only depicts the arrangement for lamp 38, it is evident that the arrangement utilized for photosensor 50 is substantially identical thereto. As shown in FIG. 3, air flows in the direction of arrow 70. Closure member 40 is a tubular shell having an inlet aperture 44 and outlet aperture 46 therein. Laminar flow maintaining means 48 is a tubular shell 72 having end portion 74 thereof integral with outlet aperture 46 (as shown by the dotted line in FIG. 3) of closure member 40. The other end portion 76 of tubular shell 72 is flared in an outwardly direction. The design of closure member 52 and tubular shell 72 is such that movement of the fluid therein is laminar. By this it is meant that the velocity near the wall of the tubular shell is approximately 0 and reaches its maximum in the center. Hence, the velocity distribution of the fluid flow is parabolic, the maximum velocity being twice the average velocity. In this way, each layer or laminar of fluid retains its identity. The local disturbances of the surface are insignificant compared to the energy required to overcome the shearing stress within the fluid body. The laminar flow condition is satisfied if the Reynolds Number remains quite small, i.e., less than 2,000. Hence, flared portion 76 of tublar shell 72 must be designed so that laminar flow rather than turbulent flow is achieved. This is accomplished by maintaining the appropriate rate of volume flow, shell diameter, length of shell, and extent of flare. It will be readily apparent to one skilled in the art that the flow rate, shell diameter and flare diameters dictate the characteristics of the flow and are designed to maintain the Reynolds Number below 2,000 so that turbulence is minimized and laminar flow is maintained. If turbulence occurs, to the back pressure may attract particles to light source 38 and photosensor 52 rather than removing them therefrom.

In recapitulation, it is apparent that the present invention simulates the electrostatic latent image recorded on the photoconductive surface. The simulated image attracts toner particles thereto which have the density thereof detected by directing light rays thereon, the intensity thereof being sensed by the photosensor. Erroneous signals are prevented by the utilization of an air flow system adapted to prevent the accumulation of contaminating deposits thereon. The air flow is maintained laminar to prevent the development of a back pressure which attracts toner particles to the light source as well as the photosensor. Hence, the regulating apparatus of the present invention senses the concentration of toner particles within the development system without the introduction of erroneous results due to the accumulation of particle contamination on the light source or photosensor.

It is, therefore, apparent that there has been provided in accordance with this invention, a system that fully satisfies the objects, aims and advantages set forth above. While this invention has been described in conjunction with specific embodiments thereof, it is evident that many alternatives, modifications, and variations will be apparent to those skilled in the art. Accordingly, it is intended to embrace all such alternatives, modifications and variations as fall within the spirit and broad scope of the appended claims.

What is claimed is:

1. A multicolor electrophotographic printing machine of the type having a photoconductive drum for recording successive single color electrostatic latent images which are rendered viewable by a development apparatus adapted to deposit toner particles complementary in color thereon, and a developability regulating apparatus comprising a light source arranged to illuminate an electrode mounted on the photoconductive drum and electrically biased to a voltage level sufficient to attract toner particles thereto during the development of the latent image and a photosensor for detecting the intensity of the light rays reflected from the electrode to indicate the density of the toner particles deposited thereon, wherein the improvement includes:

a first tubular shell arranged to support the light source therein, said first tubular shell having inlet and outlet apertures therein with the light source positioned in the region of the inlet aperture to produce light rays directed outwardly from the light source through the outlet aperture of said first tubular shell to the electrode;

first means, in communication with said first tubular shells, for creating a fluid flow in said first tubular shell, directed from the inlet aperture to the outlet aperture thereof;

a second tubular shell having one end portion thereof integral with said first tubular shell in the region of the outlet aperture and the other end portion thereof flared in an outwardly direction to maintain substantially laminar fluid flow in said first tubular shell to prevent the accumulation of contaminating deposits on the light source;

a housing arranged to support the photosensor therein, said housing having inlet and outlet apertures therein with the photosensor positioned in the region of the inlet aperture thereof to detect the intensity of light rays transmitted inwardly to the photosensor from the electrode;

means in communication with said housing for creating a fluid flow in said housing directed from the inlet aperture to the outlet aperture thereof and means, associated with said housing for maintaining the fluid flow in said housing substantially laminar to prevent the accumulation of contaminating deposits on the photosensor.

2. A multicolor electrophotographic printing machine of the type having a photoconductive drum for recording successive single color elecrostatic latent images which are rendered viewable by a development apparatus adapted to deposit toner particles complementary in color thereon, and a developability regulating apparatus comprising a light source arranged to illuminate an electrode mounted on the photoconductive drum and electrically biased to a voltage level sufficient to attract toner particles thereto during the development of the latent image and a photosensor for detecting the intensity of the light rays reflected from the electrode to indicate the density of the toner particles deposited thereon, wherein the improvement includes;

a housing arranged to support the light source therein, said housing having inlet and outlet apertures therein with the light source positioned in the region of the inlet aperture to produce light rays directed outwardly from the light source through the outlet aperture of said housing to the elecrode;

means, in communication with said housing for creating a fluid flow in said housing directed from the inlet aperture to the outlet aperture thereof;

means, associated with said housing for maintaining the fluid flow in said housing substantially laminar to prevent the accumulation of contaminating deposits on the light source;

a first tubular shell arranged to support the photosensor therein, said first tubular shell having inlet and outlet apertures therein with the photosensor positioned in the region of the inlet aperture thereof to detect the intensity of light rays transmitted inwardly to the photosensor from the electrode;

means, in communication with said tubular shell, for creating a fluid flow in said first tubular shell directed from the inlet aperture to the outlet aperture thereof; and a second tubular shell having one end portion thereof integral with said first tubular shell in the region of the outlet aperture thereof and the other end portion thereof flared in an outwardly direction to maintain substantially laminar fluid flow to prevent the accumulation of accumulation of particles on the photosensor.

* * * * *